US005738964A

United States Patent [19]

Uchida et al.

[11] Patent Number: 5,738,964

[45] Date of Patent: Apr. 14, 1998

[54] ELECTROPHOTOGRAPHIC TONER WITH SPECIFIC HIGH, MEDIUM, AND LOW MOLECULLAR WEIGHT PEAKS

[75] Inventors: Tsuyoshi Uchida; Yuji Marukawa; Hiroyuki Kozuru, all of Hachioji, Japan

[73] Assignee: Konica Corporation, Japan

[21] Appl. No.: 746,633

[22] Filed: Nov. 13, 1996

[30] Foreign Application Priority Data

Nov. 16, 1995 [JP] Japan ..... 7-298351

[51] Int. Cl.[6] ..... G03G 9/087

[52] U.S. Cl. ..... 430/109; 430/110

[58] Field of Search ..... 430/106, 108, 430/110, 109, 111

[56] References Cited

U.S. PATENT DOCUMENTS 5,489,498 2/1996 Ohno et al. ..... 430/110

5,514,510 5/1996 Hayakawa ..... 430/108

5,514,511 5/1996 Iwamoto et al. ..... 430/110

*Primary Examiner*—John Goodrow

*Attorney, Agent, or Firm*—Jordan B. Bierman; Bierman, Muserlian and Lucas

[57] ABSTRACT

An electrophotographic toner is disclosed. The toner comprises a binder resin, a colorant and a mold releasing material, and the binder resin contains 8–32% by weight of 20,000–300,000 molecular weight component (MP), 12–28% by weight of high molecular weight component exceeding 300,000 (HP); that said HP content and MP content satisfy the following equation;

$$45\ (\%) \leqq \text{MP Ratio} + \text{HP Ratio} \times 2 \leqq 65\ (\%)$$

and the glass transition point of the binder resin is 52°–62° C. A method of fixing toner images using a heat roller is also disclosed.

5 Claims, 1 Drawing Sheet

ELECTROPHOTOGRAPHIC TONER WITH SPECIFIC HIGH, MEDIUM, AND LOW MOLECULLAR WEIGHT PEAKS

BACKGROUND OF THE INVENTION

The present invention relates to toner for developing electrostatic images used in electrophotography, electrostatic recording, electrostatic printing, etc., and a method of thermal fixing.

The electrophotographic process is a process, whereby a permanent image is formed through steps comprising:

forming an electrostatic latent image on the surface of a photoreceptor;

adhering toner particles on the latent image using a developing means such as a magnetic brush, etc.;

transferring the thus visualized image on a transfer material; and, fusing and fixing developing agent to make the toner image into a permanent image. The toner particles remaining on the photoreceptor are removed from the surface of the photoreceptor using a cleaning member.

The electrophotographic toner is concerned in all the above-mentioned steps. Accordingly, various properties are required for toner used in electrophotography.

Progress in electrophotographic technology in the recent years has been remarkable, and a variety of duplicating machines have been developed. However, the demand for duplicating machines with enhanced copying speed, reliability and image quality has continued. In addition, automatic duplication on both surfaces, automatic feeding of the original document, etc. Are starting to be considered as natural functions.

Further, recently, composite machines, in which not only copying the original image, but also a printer for the computer output or a printer is composed, became popular.

As regards printers or composite machines, more compact and simpler apparatus has been demanded. These various demands to these copying machines or printers, that is to say, in order to achieve speed-up, high reliability, high image quality, down-sizing and simplification, improvement in the electrophotographic toner technology, in particular, drastic improvement in the properties of the binder resin is indispensable.

For the purpose of achievement of speed-up and high reliability, it is necessary for the toner image to be fixed quicker and for the image after fixing not to be disturbed easily, or, in other words, it is indispensable for the fixing performance and anti-offset property to be more superior than they used to be.

In order to obtain high quality images stably, it is required that electrification property of the toner is not easily affected by the surrounding conditions. When automatic copying of both surfaces or automatic document feeding is carried out, contamination is often taken place on the original document or on the copied image due to rubbing between conveyance roller and the original document or the copy, or rubbing between original document and copied images. In order to promote further automation, it is indispensable solve this problem of contamination.

Down-sizing and simplification of the copying machines or printers inevitably mean that respective elements of the apparatuses are arranged in a very limited space. Accordingly, heat sources for the fixing device, or image exposing system, etc. are arranged closer to each other, and the temperature in the apparatus easily rise, and, thus, it is necessary that toner particles are not easily blocked in the development unit or a supplying device thereto.

In order to establish compatibility between the fixing performance and anti-hot-offset property, use of a binder, of which molecular weight distribution has been broadened such that weight average molecular weight (Mw)/number average molecular weight (Mn) is made between 3.5 and 40 has been proposed in Japanese Patent publication No. 55-6895/1980. Moreover, in Japanese Patent O.P.I. publication No. 56-16144/1981, toner which has at least one maximum peaks in the molecular weight ranges between $10^3$–$8\times10^4$ and between $10^5$–$2\times10^6$ has been proposed. According to this invention, it is possible to improve both fixing performance and anti-offset property to a certain extent. However, since the binder comprises both high molecular weight ingredient and low molecular weight ingredient, viscosity difference at the time of kneading is brought about, to deteriorate dispersion of additives. Further, because this contains lower molecular weight ingredient, dynamic strength of the toner is lowered, and contamination in the image at the time of automatic double-sided copying takes place.

On the contrary to this, Japanese Patent OP. Publication No. 4-190244/1992 has proposed a toner binder consisting of a high molecular weight ingredient of 300,000 or more, intermediate molecular weight ingredient of between 50,000 and 200,000 and low molecular weight ingredient between 1,000 and 30,000, and Japanese Patent O.P.I. Publication No. 1-221758/1989 has proposed a binder having at least three molecular weight peaks between $10^3$ and $10^7$. In accordance with these inventions, insufficient dispersion of additives and contamination take place.

Like this, toner which satisfies all of fixing performance, anti-hot offset performance, anti-blocking property and anti-contamination property is not known.

SUMMARY OF INVENTION

In view of the state of the art as mentioned above, the objective of the present invention is to provide toner for electrophotography, which is excellent in all of fixing performance, anti-hot offset property, anti-coagulation property, electrification property and anti-contamination property.

Another objective of the present invention is to provide a method of heat roll fixing of electrophotographic toner image.

It is found that glass transition point, acid value and distribution of molecular weight of the binder resin used in the toner have an effect on fixing performance, anti-hot offset property, anti-coagulation property, electrification property and anti-contamination property.

The electrophotographic toner of the invention comprises a binder resin, a colorant, and a releasing agent, wherein said binder resin has such property in its molecular weight distribution measured by gel permeation chromatography that (1) said binder resin has a main peak in the molecular weight range between 3,000–5,000;

(2) said binder resin has a peak or a shoulder in the molecular weight range between 80,000–240,000;

(3) said binder resin has a peak or a shoulder in the molecular weight range between 400,000–650,000;

(4) component having the molecular weight less than 20,000 (low molecular weight component; LP) is 56–70% by weight;

(5) component having the molecular weight between 20,000–300,000 (medium molecular weight component; MP) is 8–32% by weight;

(6) component having the molecular weight greater than 300,000 (high molecular weight component; HP) is 12–28% by weight;

(7) HP content and MP content satisfy the following relation;

$$45\ (\%) \leqq \text{MP Ratio} + \text{HP Ratio} \times 2 \leqq 65\ (\%);$$

and that (8) the glass transition point of said resin is between 52° C. and 62° C.

MP Ratio is content of the medium molecular weight component having the molecular weight between 20,000–300,000 of the resin in percent, and HP Ratio is content of the high molecular weight component having the molecular weight greater than 300,000 of the resin in percent.

It is preferable that the above-mentioned binder resin has an acid ingredient in LP and/or MP and the acid value of the toner is 0.1–5 KOH mg/g.

Visualized images formed by the above-mentioned toner is transported to a heat roll fixing unit comprising a heat roll and a pressure roll and the toner image is fixed by being brought in contact with the heat roll and is fixed by pressure and heat onto a recording material.

DETAILED DESCRIPTION OF THE INVENTION

Figure 1:
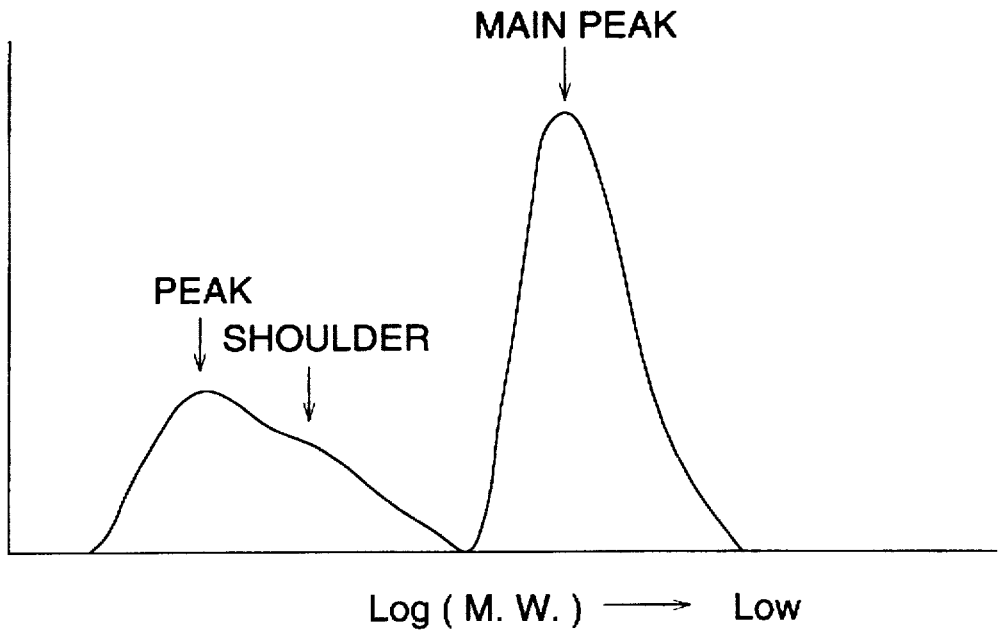
FIG. 1 and FIG. 2 illustrate GPC chlomatogram of the binder resin.
Figure 2:
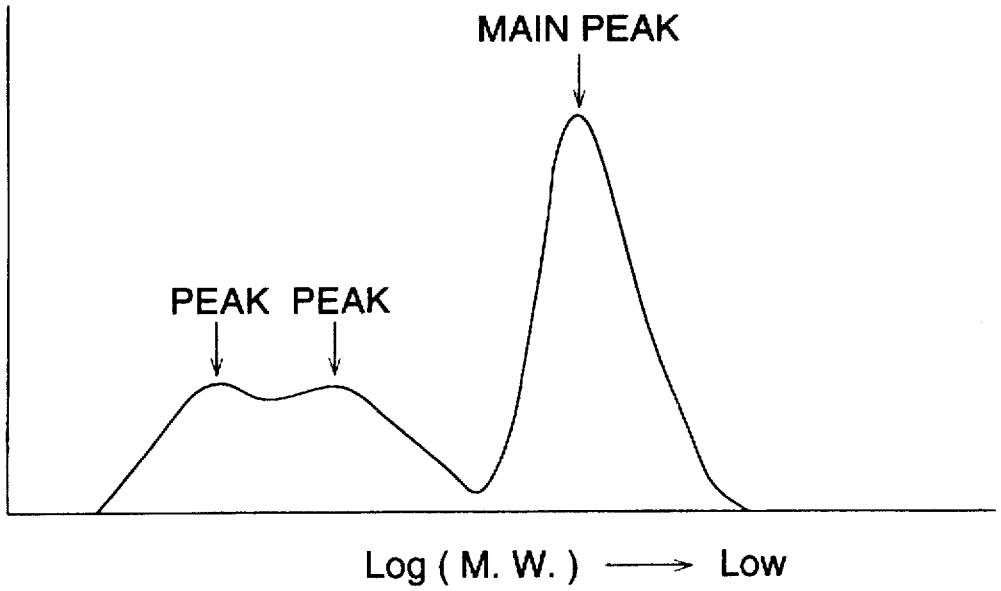

The present invention is described in more detail.

Binder resin used in the toner for electrophotography is explained.

The binder resin used in the electrophotographic toner has its main peak in the molecular weight range between 3,000–5,000 measured by the gel permeation chromatography. The main peak means the highest peak in the gel permeation chromatograph chart. By residing the peak molecular weight between 3,000 and 5,000, dynamic strength of the binder resin is secured, while preventing breaking due to fragility. Thus, occurrence of roll marks at the time of automatic double-sided copying can be restrained. Further, molecular weight dependence of the glass transition point is little, and because appropriate glass transition point is obtained, preferable anti-coagulation property can be obtained.

Further, it is preferable that the binder resin for the toner has a peak or a shoulder within a molecular weight range between 80,000–240,000 in the molecular weight distribution measured by gel permeation chromatography. It is considered that the molecular weight component between 80,000–240,000 exerts as a dispersion aid for LP and HP. That is to say, because of presence of the molecular weight component as mentioned above, dispersion of additives is improved, and, in addition, anti-contamination property can be improved without losing the fixing property and, thus, preferable balance between the fixing performance and the anti-abrasion property can be obtained.

It is preferable that the binder resin for the toner has a molecular weight peak or a shoulder in the molecular weight range between 400,000–650,000 in the molecular weight distribution measured by gel permeation chromatography. Owing to the presence of the molecular weight component as above, preferable fixing performance and anti-offset property are secured.

It is preferable that the binder resin has 56–70% by weight of a molecular weight component having molecular weight not greater than 20,000. Owing to this, appropriate fusing viscosity and preferable anti-offset property can be obtained.

It is preferable that the binder resin has 8–32% by weight of a molecular weight component having molecular weight between 20,000–300,000. When this is smaller than 8%, MP works exerts the effect as a dispersion aid for LP and HP and, thus preferable dispersion of additives may be obtained. In addition, fixing performance and anti-contamination property can also be obtained with a good balance. When, on the other hand, this exceeds 32% by weight, either fixing performance or anti-offset property will be deteriorated.

It is preferable that the binder resin has 12–28% by weight of a molecular weight component having molecular weight greater than 300,000. Owing to this, sufficient elasticity at the time when the binder is fused can be obtained. In addition, preferable anti-hot offset property can also be obtained. Further, it can give appropriate fusing viscosity at the temperature of fixing and, accordingly, preferable fixing performance can be obtained.

It is preferable that the content of HP and the content of MP of the binder resin preferably suffice the following equation in the molecular weight distribution measured by gel permeation chromatography.

$$45\ (\%) \leqq \text{MP Ratio} + \text{HP Ratio} \times 2 \leqq 65\ (\%);$$

According to this fixing performance, anti-hot offset property and anti-contamination property can be all satisfied at the same time.

Glass transition point of the binder resin component is 52°–60° C. This glass transition point coincides with the glass transition point of the toner having this resin. According to this preferable anti-coagulation property and fixing property of the toner can be obtained.

It is preferable that the binder resin has LP and/or MP and an acid ingredient and the acid value of the toner is 0.1–5 KOH mg/g. Owing to this, affinity between the toner and paper is increased and fixing performance is improved. Further, dependence of electrification on temperature and humidity is lowered, and image fogging, toner scattering, lowering of image density, blur in the image can be restrained.

The acid value of the toner is measured in the conventional way, for example, according to JIS K0070 (1992). The sample of the toner is dissolved in toluene when the titration is conducted.

Molecular weight distribution of the binder resin can be measured according to the following method. After weighing 1–10 mg toner in a conical flask, 10 ml of THF (tetrahydrofurane) is added to this, to prepare THF solution, of which binder concentration is 0.1–1.0 mg/ml. A Column is stabilized in a heat chamber at 40° C., and into the column at this temperature THF as a solvent was let run at the flowing rate of 1 ml/min. and 100 μl of the above-mentioned THF sample solution was injected. Molecular weight of the sample is calculated from the relation between logarithm of a calibration curve and retention time prepared using mono-dispersion polystyrene standard sample. The calibration curve is prepared using ten mono-dispersion polystyrene standard samples having different molecular weight. As the mono-dispersion polystyrene standard sample, for example, one having molecular weight between $2.7\times10^2$–$6.2\times10^6$, a product of Toso is used. As a detection device, a refraction index (RI) is used. As the column, for example, TSK gel, G1000H, G2000H, G3000H, G4000H, G5000H, G6000H, G7000H and GMH, products of Toso are used in combination.

The glass transition point of the binder resin component is measured by the method shown below.

Toner in an amount of 5 mg was weighed, put in an aluminum pan, and sealed. This sample was, next, heated from 0° C. to 200° C. at a heating rate at 10° C./min. and was left as it is for three minutes at 200° C. Then, it was cooled down to 0° C. at cooling rate at 10° C./min. Then, this was heated again to 200° C. at the heating rate at 10° C./min.

The extended line of the base line of the calorimetric curve at the time of second heating, and the intersectional point of the extended line of the tangent at the point of the calorimetric curve between the rising portion and the peak of the endothermic curve thereof and the peak, at which inclination shows a maximum value, is made to be the glass transition point.

For the binder resin, vinyl-type resins are used preferably. As the vinyl resin, for example, styrene monomer and/or acrylate or methacrylate monomer, and copolymers consisting of acrylic acid- or methacrylic acid-type monomer component and having a carboxylic group in the side chain can be used.

For the styrene monomer, for example, styrene, o-methylstyrene, m-methylstyrene, p-methylstyrene, α-methylstyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorophenylstyrene, 3,4-dichlorostyrene, etc. can be mentioned. Among these, styrene is preferable.

For the acrylate or methacrylate monomers, for example, alkyl esters of acrylic acid or methacrylic acid including, for example, methylacrylate, ethylacrylate, propyl acrylate, n-butyl acrylate, isobutyl acrylate, n-octyl acrylate, dodecyl acrylate 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, etc.; 2-chloroethyl acrylate, phenyl acrylate, α-chloro-methyl acrylate, phenyl methacrylate, dimethylamino methacrylate, dimethylamino-ethyl methacrylate, diethylaminoethyl methacrylate, etc. can be mentioned. Among these, alkyl esters of acrylic acid or methacrylic acid such as ethyl acrylate, propyl acrylate, n-butyl acrylate, ethyl methacrylate, propyl methacrylate, n-butyl methacrylate, etc. are preferable and, in particular, n-butyl acrylate, methyl methacrylate, n-butyl methacrylate, etc. are preferable.

For acrylic acid or methacrylic acid monomer, acrylic acid an methacrylic acid are preferable as examples of acidic monomer to make the polymer have an adequate acid value.

For polymerization of this styrene-acryl component, solution polymerization, suspension polymerization, emulsion polymerization, or block polymerization is used. Among these, solution polymerization and suspension polymerization are most suitably used.

The binder resin component may also be obtained by mixing polymers of high, intermediate and low polymerization degrees in a solvent, or by preparing polymers of high and intermediate polymerization degrees in advance and admixing this in a solution containing polymerized, LP, or by polymerizing polymers of high and intermediate polymerization degrees in advance, and by polymerizing the low molecular weight polymer in the presence of these components.

The toner may comprise a releasing agent such as wax. For the wax, for example, low molecular weight polyolefins or derivatives thereof, such as polypropyrene, polyethylene, etc.; alkylene bis aliphatic fatty acid amide compounds, paraffin wax or any combination of two or more kinds of these, etc. can suitably be used. Suitable content of this wax is 1–20 parts by weight and, particularly, 2–15 parts by weight with respect to 100 parts of the binder resin.

The toner can comprise magnetic powder. For magnetic material constituting the magnetic powder, for example, metal oxide such as magnetite, hematite, ferrite, etc.; metallic elements such as iron, nickel, cobalt, etc.; and alloys consisting of these metallic elements and other metals including, for example, aluminum, cobalt, copper, lead, magnesium, tin, zinc, antimony, beryllium, bismuth, cadmium, calcium, manganese, selenium, titanate, tungsten, vanadium, etc. can be mentioned.

The magnetic material preferably has a volume average diameter of 0.1–2 μm and, preferably, 0.1–0.5 μm. The amount to be incorporated in the toner is preferably 40–150 parts by weight with respect to 100 parts by weight of the resin component.

The toner comprises a colorant. As the colorant, for example, carbon black, Nigrosine dyes, aniline blue, calcoil blue, chrome yellow, ultra-marine blue, du Pont oil red, orient oil red, quinoline yellow, methylene blue chloride, phthalocyanine blue, marachite green oxalate, lump black, rose bengal, etc. can be mentioned.

The toner is manufactured in the following manner, for an example.

After dry-blending the binder resin component, colorant, a releasing agent and, if necessary, magnetic powder, they are fused, kneaded and mixed using an extruder, a kneader, kneading roll machine and sealed mixing machine, etc. so that the respective components are uniformly mixed in the toner. After cooling the mixture is pulverized with a jet mill, turbo mill, etc., and classified so that the toner particles have pre-determined particle diameter. And the toner is obtained by dry-blending thus classified toner particles, additives such as silica and, if necessary, a cleaning aid.

As for method of fixing an image formed on a recording material such as paper, heat roll fixing method is suitably used. The fixing unit used in this method is comprised of an upper roll made of a cylindrical metal such as aluminum, inside of which is provided a heat source and on the outer surface of which is covered with polytetrafluoroethylene or polytetrafluoro ethylene—perfluoroalkoxyvinyl ether copolymer, etc., and a lower roll made of an elastomer such as a silicon rubber, etc. More specifically, this unit contains a linear heater in the upper roll and raise the surface temperature of the upper roll to 120°–200° C. In the fixing portion, pressure is applied between the upper roll and the lower roll, to form a nip. Width of the nip is 1–10 mm and, preferably, 1.5–7 mm. Preferable linear fixing speed is 40–400 mm/sec.

In either case, if necessary, a fixing and cleaning mechanism may be provided. In this case, a method whereby silicon oil is supplied to the upper roll of the fixing unit or to a film, or a method wherein cleaning is carried out using a pad roll web into which silicon oil has been impregnated, can be used. For the silicon oil, one having high heat resistance such as polydimethyl silicon, polyphenylmethyl silicon, etc can be used, since the use of one having low viscosity is likely to result in large quantity of flow out at the time of use, one having viscosity at 20° C. of 1,000–1,000,000 cp is adequately be used.

EXAMPLE

Manufacturing Example of Binder Resin 1

55 parts by weight of a polymer consisting of styrene and acrylic acid and having a molecular weight maximum at 3,000, 20 parts by weight of a polymer consisting of styrene, butylacrylate and acrylic acid and having a molecular weight maximum at 100,000, and 25 parts by weight of a polymer consisting of styrene and butyl acrylate and having a molecular weight maximum at 650,000 were blended uniformly in xylene. Then xylene was refluxed out under reduced pressure, to obtain Binder Resin 1.

Manufacturing Example of Binder Resin 2

65 parts by weight of a polymer consisting of styrene, methyl methacrylate and acrylic acid and having a molecular weight maximum at 3,300, 10 parts by weight of a polymer consisting of styrene, butyl acrylate and acrylic acid, and having a molecular weight maximum at 100,000, and 25 parts by weight of a polymer consisting of styrene and butylacrylate and having a molecular weight maximum at 650,000 were blended uniformly in xylene. Xylene was refluxed out under reduced pressure, to obtain Binder Resin 2.

Manufacturing Example of Binder Resin 3

50 parts by weight of a polymer consisting of styrene, and acrylic acid and having a molecular weight maximum at 3,000, 25 parts by weight of a polymer consisting of styrene, butyl acrylate and acrylic acid, and having a molecular weight maximum at 100,000, and 25 parts by weight of a polymer consisting of styrene and butylacrylate and having a molecular weight maximum at 650,000 were blended uniformly in xylene. Xylene was then refluxed out under reduced pressure, to obtain Binder Resin 3.

Manufacturing Example of Binder Resin 4

65 parts by weight of a polymer consisting of styrene, and having a molecular weight maximum at 3,000, 10 parts by weight of a polymer consisting of styrene, butyl acrylate and acrylic acid, and having a molecular weight maximum at 100,000, and 20 parts by weight of a polymer consisting of styrene and butylacrylate and having a molecular weight maximum at 650,000 were blended uniformly in xylene. Xylene was then refluxed out under reduced pressure, to obtain Binder Resin 4.

Manufacturing Example of Binder Resin 5

55 parts by weight of a polymer consisting of styrene, and having a molecular weight maximum at 3,000, 25 parts by weight of a polymer consisting of styrene, butyl acrylate and acrylic acid, and having a molecular weight maximum at 100,000, and 20 parts by weight of a polymer consisting of styrene, methyl methacrylate and butyl acrylate and having a molecular weight maximum at 650,000 were blended uniformly in xylene. Xylene was then refluxed out under reduced pressure, to obtain Binder Resin 5.

Manufacturing Example of Binder Resin 6

60 parts by weight of a polymer consisting of styrene, butylacrylate and acrylic acid and having a molecular weight maximum at 3,000, 10 parts by weight of a polymer consisting of styrene, butyl acrylate and acrylic acid, and having a molecular weight maximum at 100,000, and 30 parts by weight of a polymer consisting of styrene and butyl acrylate and having a molecular weight maximum at 650,000 were blended uniformly in xylene. Xylene was then refluxed out under reduced pressure, to obtain Binder Resin 6.

Manufacturing Example of Binder Resin 7

60 parts by weight of a polymer consisting of styrene, butylacrylate and acrylic acid and having a molecular weight maximum at 4,500, 15 parts by weight of a polymer consisting of styrene, butyl acrylate and acrylic acid, and having a molecular weight maximum at 100,000, and 25 parts by weight of a polymer consisting of styrene and butyl acrylate and having a molecular weight maximum at 700,000 were blended uniformly in xylene. Xylene was then refluxed out under reduced pressure, to obtain Binder Resin 7.

Manufacturing Example of Binder Resin 8

55 parts by weight of a polymer consisting of styrene and acrylic acid and having a molecular weight maximum at 2,800, 20 parts by weight of a polymer consisting of styrene, butyl acrylate and acrylic acid, and having a molecular weight maximum at 100,000, and 25 parts by weight of a polymer consisting of styrene and butyl acrylate and having a molecular weight maximum at 650,000 were blended uniformly in xylene. Xylene was then refluxed out under reduced pressure, to obtain Binder Resin 8.

Manufacturing Example of Binder Resin 9

70 parts by weight of a polymer consisting of styrene, methyl methacrylate and acrylic acid and having a molecular weight maximum at 5,500, 5 parts by weight of a polymer consisting of styrene, butyl acrylate and acrylic acid, and having a molecular weight maximum at 100,000, and 25 parts by weight of a polymer consisting of styrene and butyl acrylate and having a molecular weight maximum at 650,000 were blended uniformly in xylene. Xylene was then refluxed out under reduced pressure, to obtain Binder Resin 9.

Manufacturing Example of Binder Resin 10

65 parts by weight of a polymer consisting of styrene and acrylic acid and having a molecular weight maximum at 3,000, 35 parts by weight of a polymer consisting of styrene and butyl acrylate, and having a molecular weight maximum at 700,000, were blended uniformly in xylene. Xylene was then refluxed out under reduced pressure, to obtain Binder Resin 10.

Manufacturing Example of Binder Resin 11

55 parts by weight of a polymer consisting of styrene and acrylic acid and having a molecular weight maximum at 3,000, 20 parts by weight of a polymer consisting of styrene, butyl acrylate and acrylic acid, and having a molecular weight maximum at 50,000 and a polymer consisting of styrene and butyl acrylate, and having a molecular weight maximum at 650,000 were blended uniformly in xylene. Xylene was then refluxed out under reduced pressure, to obtain Binder Resin 11.

Manufacturing Example of Binder Resin 12

55 parts by weight of a polymer consisting of styrene, methyl methacrylate and acrylic acid and having a molecular weight maximum at 3,000, 10 parts by weight of a polymer consisting of styrene, butyl acrylate and acrylic acid, and having a molecular weight maximum at 100,000 and 25 parts by weight a polymer consisting of styrene and butyl acrylate, and having a molecular weight maximum at 300,000 were blended uniformly in xylene. Xylene was then refluxed out under reduced pressure, to obtain Binder Resin 12.

Manufacturing Example of Binder Resin 13

65 parts by weight of a polymer consisting of styrene, methyl methacrylate and acrylic acid and having a molecular weight maximum at 3,300, 10 parts by weight of a polymer consisting of styrene, butyl acrylate and acrylic acid, and having a molecular weight maximum at 100,000 and 25 parts by weight a polymer consisting of styrene and butyl acrylate, and having a molecular weight maximum at 800,000 were blended uniformly in xylene. Xylene was then refluxed out under reduced pressure, to obtain Binder Resin 13.

Manufacturing Example of Binder Resin 14

45 parts by weight of a polymer consisting of styrene and acrylic acid and having a molecular weight maximum at 3,000, 35 parts by weight of a polymer consisting of styrene and butyl acrylate, and having a molecular weight maximum at 100,000 and 20 parts by weight a polymer consisting of styrene and butyl acrylate, and having a molecular weight maximum at 650,000 were blended uniformly in xylene. Xylene was then refluxed out under reduced pressure, to obtain Binder Resin 14.

Manufacturing Example of Binder Resin 15

45 parts by weight of a polymer consisting of styrene and acrylic acid and having a molecular weight maximum at 3,000, 35 parts by weight of a polymer consisting of styrene and butyl acrylate, and having a molecular weight maximum at 100,000 and 20 parts by weight a polymer consisting of styrene and butyl acrylate, and having a molecular weight maximum at 650,000 were blended uniformly in xylene. Xylene was then refluxed out under reduced pressure, to obtain Binder Resin 15.

Manufacturing Example of Binder Resin 16

55 parts by weight of a polymer consisting of styrene and acrylic acid and having a molecular weight maximum at 3,000, 35 parts by weight of a polymer consisting of styrene and butyl acrylate and acrylic acid and having a molecular weight maximum at 100,000 and 10 parts by weight a polymer consisting of styrene and butyl acrylate, and having a molecular weight maximum at 650,000 were blended uniformly in xylene. Xylene was then refluxed out under reduced pressure, to obtain Binder Resin 16.

Manufacturing Example of Binder Resin 17

55 parts by weight of a polymer consisting of styrene and having a molecular weight maximum at 3,100, 25 parts by weight of a polymer consisting of styrene and butyl acrylate and acrylic acid and having a molecular weight maximum at 100,000 and 10 parts by weight a polymer consisting of styrene, methyl methacrylate and butyl acrylate, and having a molecular weight maximum at 650,000 were blended uniformly in xylene. Xylene was then refluxed out under reduced pressure, to obtain Binder Resin 17.

Manufacturing Example of Binder Resin 18

55 parts by weight of a polymer consisting of styrene, butyl acrylate and acrylic acid and having a molecular weight maximum at 3,000, 25 parts by weight of a polymer consisting of styrene, butyl acrylate and acrylic acid and having a molecular weight maximum at 100,000 and 20 parts by weight a polymer consisting of styrene, methyl methacrylate and butyl acrylate, and having a molecular weight maximum at 650,000 were blended uniformly in xylene. Xylene was then refluxed out under reduced pressure, to obtain Binder Resin 18.

Manufacturing Example of Binder Resin 19

65 parts by weight of a polymer consisting of styrene and having a molecular weight maximum at 3,000, 10 parts by weight of a polymer consisting of styrene, butyl acrylate, methyl methacrylate and acrylic acid and having a molecular weight maximum at 100,000 and 30 parts by weight a polymer consisting of styrene and butyl acrylate, and having a molecular weight maximum at 650,000 were blended uniformly in xylene. Xylene was then refluxed out under reduced pressure, to obtain Binder Resin 19.

Manufacturing Example of Binder Resin 20

60 parts by weight of a polymer consisting of styrene and acrylic acid and having a molecular weight maximum at 3,000, 10 parts by weight of a polymer consisting of styrene, butyl acrylate, methyl methacrylate and acrylic acid and having a molecular weight maximum at 100,000 and 30 parts by weight a polymer consisting of styrene and butyl acrylate, and having a molecular weight maximum at 650,000 were blended uniformly in xylene. Xylene was then refluxed out under reduced pressure, to obtain Binder Resin 20.

Manufacturing Example of Binder Resin 21

0 parts by weight of a polymer consisting of styrene and acrylic acid and having a molecular weight maximum at 3,000, 15 parts by weight of a polymer consisting of styrene, butyl acrylate and acrylic acid and having a molecular weight maximum at 100,000 and 35 parts by weight a polymer consisting of styrene and butyl acrylate, and having a molecular weight maximum at 650,000 were blended uniformly in xylene. Xylene was then refluxed out under reduced pressure, to obtain Binder Resin 21.

Manufacturing Example of Binder Resin 22

65 parts by weight of a polymer consisting of styrene and acrylic acid and having a molecular weight maximum at 3,000, 20 parts by weight of a polymer consisting of styrene, butyl acrylate and acrylic acid and having a molecular weight maximum at 100,000 and 15 parts by weight a polymer consisting of styrene and butyl acrylate, and having a molecular weight maximum at 650,000 were blended uniformly in xylene. Xylene was then refluxed out under reduced pressure, to obtain Binder Resin 22.

The manufacturing examples of the above-mentioned binder resins are shown in Table 1.

TABLE 1

| Resin Manufacturing Example No. | LP Component Composition | LP Peak Molecular Weight × $10^4$ | MP Component Composition | MP Peak Nolecular Weight × $10^4$ | HP Component Composition | HP Peak Molecular Weight × $10^3$ | LP/MP/HP Weight Ratio |
|---|---|---|---|---|---|---|---|
| 1 | St/AA | 3.0 | St/BA/AA | 10 | St/BA | 650 | 55/20/25 |
| 2 | St/MMA/AA | 3.3 | St/BA/AA | 10 | St/BA | 650 | 65/10/25 |
| 3 | St/AA | 3.0 | St/BA/AA | 10 | St/BA | 650 | 50/25/25 |
| 4 | St | 3.0 | St/BA/AA | 10 | St/BA | 650 | 65/10/25 |
| 5 | St | 3.0 | St/BA/AA | 10 | St/MMA/BA | 650 | 55/25/20 |
| 6 | St/AA | 3.0 | St/BA/AA | 10 | St/BA | 650 | 60/10/30 |
| 7 | St/AA | 4.5 | St/BA/AA | 10 | St/BA | 700 | 60/15/25 |
| 8 | St/AA | 2.8 | St/BA/AA | 10 | St/BA | 650 | 55/20/25 |
| 9 | St/MMA/AA | 2.5 | St/BA/AA | 10 | St/BA | 650 | 70/5/25 |
| 10 | St/AA | 3.0 | | | St/BA | 700 | 65/0/35 |
| 11 | St/AA | 3.0 | St/BA/AA | 5 | St/BA | 650 | 55/20/25 |
| 12 | St/MMA/AA | 3.0 | St/BA/AA | 10 | St/BA | 300 | 55/10/35 |
| 13 | St/MMA/AA | 3.3 | St/BA/AA | 10 | St/BA | 800 | 65/10/25 |
| 14 | St/AA | 3.0 | St/BA/AA | 10 | St/BA | 650 | 45/35/20 |
| 15 | St/AA | 3.0 | St/BA/AA | 10 | St/BA | 650 | 70/5/25 |
| 16 | St/AA | 3.0 | St/BA/AA | 10 | St/BA | 650 | 55/35/10 |
| 17 | St | 3.1 | St/BA/AA | 10 | St/MMA/BA | 650 | 55/25/20 |
| 18 | St/BA/AA | 3.0 | St/BA/AA | 10 | St/MMA/BA | 650 | 55/25/20 |
| 19 | St | 3.0 | St/BA | 10 | St/BA | 650 | 65/10/25 |
| 20 | St/AA | 3.0 | St/MMA/BA/AA | 10 | St/BA | 650 | 60/10/30 |
| 21 | St/AA | 3.0 | St/BA/AA | 10 | St/BA | 650 | 50/15/35 |
| 22 | St/AA | 3.0 | St/BA/AA | 10 | St/BA | 650 | 65/20/15 |

Notes)
St: Styrene; BA: Butyl acrylate; MMA: Methyl methacrylate; AA: Acrylic acid (Manufacturing Example of Toner)

Manufacturing Example of Toner 1

After 100 parts by weight of binder resin, 10 parts by weight of carbon black and 4 parts by weight of polypropylene wax were fused and kneaded in a two-axis kneader, the mixture was pulverized with a jet mill and classified with a wind classifier to obtain a toner composition having a volume average particle diameter being 8.5 μm. Then to 100 parts by weight of this toner composition, 1 part by weight of hydrophobic silica was added and mixed in a dry mixer, to obtain Toner 1.

The molecular weight distribution of this toner was measured by gel permeation chromatography, and it was found that this polymer has in its chromatogram, one peak at molecular weight is 3,000 and another peak at the molecular weight is 500,000, and it has a shoulder at about 130,000. Proportion of low molecular weight component was 63% by weight, intermediate molecular weight component (MP), 20% by-weight and high molecular weight component was 17% by weight and [MP ratio+2×HP ratio]=54% by weight. Moreover the glass transition point of this toner was measured by DSC and it was found to be 55° C. Further the acid value was 4.4 (KOH mg/mg).

Manufacturing Example of Toner 2

Toner 2 was obtained in the same manner as Toner 1, except that in this example Binder Resin 2 was used. Molecular weight distribution, glass transition point and the acid value of this toner are shown in Table 2.

Manufacturing Example of Toner 3

Toner 3 was obtained in the same manner as Toner 1, except that in this example Binder Resin 3 was used. Molecular weight distribution, glass transition point and the acid value of toner are shown in Table 2.

Manufacturing Example of Toner 4

Toner 4 was obtained in the same manner as Toner 1, except that in this example Binder Resin 4 was used. Molecular weight distribution, glass transition point and the acid value of toner are shown in Table 2.

Manufacturing Example of Toner 5

Toner 5 was obtained in the same manner as Toner 1, except that in this example Binder Resin 5 was used. Molecular weight distribution, glass transition point and the acid value of toner are shown in Table 2.

Manufacturing Example of Toner 6

Toner 6 was obtained in the same manner as Toner 1, except that in this example Binder Resin 6 was used. Molecular weight distribution, glass transition point and the acid value of toner are shown in Table 2.

Manufacturing Example of Toner 7

Toner 7 was obtained in the same manner as Toner 1, except that in this example Binder Resin 7 was used. Molecular weight distribution, glass transition point and the acid value of toner are shown in Table 2.

Manufacturing Example of Toner 8–22

Toners 8–22 were obtained in the same manner as Toner 1, except that in this example each of Binder Resin 8–22 was respectively used. Molecular weight distribution, glass transition point and the acid value of toner are shown in Table 3.

TABLE 2

| Toner No. | GPC chromatogram: LP Peak Molecular Weight ($\times 10^{-3}$) | MP Peak or Shoulder Molecular Weight ($\times 10^{-3}$) | HP Peak or Shoulder Molecular Weight ($\times 10^{-3}$) | Proportion of Molecular Weight Component of less than 20,000 | Proportion of Molecular weight Component between 20,000–300,000 | Proportion of Molecular Weight Component greater than 300,000 | MP Ratio + 2 × HP | Glass Transition Point (°C.) | Acid Value (KOH mg/g) |
|---|---|---|---|---|---|---|---|---|---|
| Toner 1 | 3.0 | 130 | 500 | 63 | 20 | 17 | 54 | 55 | 4.4 |
| Toner 2 | 3.3 | 120 | 500 | 70 | 12 | 18 | 48 | 53 | 1.3 |
| Toner 3 | 3.0 | 130 | 450 | 58 | 24 | 18 | 60 | 54 | 4.7 |
| Toner 4 | 3.0 | 120 | 600 | 70 | 11 | 19 | 49 | 54 | 1.1 |
| Toner 5 | 3.0 | 120 | 450 | 64 | 22 | 14 | 56 | 56 | 2.6 |
| Toner 6 | 3.0 | 200 | 500 | 65 | 16 | 19 | 54 | 58 | 3.5 |
| Toner 7 | 4.5 | 200 | 550 | 58 | 21 | 21 | 63 | 55 | 3.6 |

TABLE 3

| Toner No. | GPC chromatogram: LP Peak Molecular Weight ($\times 10^{-3}$) | MP Peak or Shoulder Molecular Weight ($\times 10^{-3}$) | HP Peak or Shoulder Molecular Weight ($\times 10^{-3}$) | Proportion of Molecular Weight Component of less than 20,000 | Proportion of Molecular weight Component between 20,000–300,000 | Proportion of Molecular Weight Component greater than 300,000 | MP Ratio + 2 × HP | Glass Transition Point (°C.) | Acid Value (KOH mg/g) |
|---|---|---|---|---|---|---|---|---|---|
| Toner 8 | 2.8 | 130 | 500 | 63 | 20 | 17 | 54 | 54 | 4.4 |
| Toner 9 | 5.5 | 120 | 500 | 56 | 25 | 19 | 63 | 63 | 1.3 |
| Toner 10 | 3.0 | — | 600 | 70 | 3 | 27 | 57 | 57 | 2.4 |
| Toner 11 | 3.0 | 60 | 520 | 65 | 20 | 15 | 50 | 54 | 4.4 |
| Toner 12 | 3.0 | 200 | 300 | 63 | 22 | 15 | 58 | 56 | 4.5 |
| Toner 13 | 3.3 | 120 | 700 | 70 | 10 | 20 | 50 | 53 | 1.2 |
| Toner 14 | 3.0 | 130 | 450 | 54 | 31 | 15 | 61 | 54 | 4.6 |
| Toner 15 | 3.0 | 120 | 500 | 73 | 8 | 19 | 46 | 54 | 4.5 |
| Toner 16 | 3.0 | 100 | 400 | 63 | 29 | 8 | 45 | 54 | 4.8 |
| Toner 17 | 3.1 | 120 | 450 | 64 | 22 | 14 | 63 | 65 | 2.4 |
| Toner 18 | 3.0 | 120 | 450 | 64 | 22 | 14 | 63 | 49 | 2.6 |
| Toner 19 | 3.0 | 120 | 600 | 70 | 11 | 19 | 49 | 60 | 0.0 |
| Toner 20 | 3.0 | 200 | 500 | 65 | 16 | 19 | 54 | 53 | 9.2 |
| Toner 21 | 3.0 | 190 | 500 | 58 | 12 | 30 | 66 | 55 | 3.5 |
| Toner 22 | 3.0 | 120 | 450 | 70 | 18 | 12 | 42 | 56 | 4.8 |

(Evaluation of Toner)

Six (6) parts each of Sample Toners and 100 parts by weight of fluorine-type carrier (volume average diameter: 65 μm) were mixed and were used for practical copying evaluation. The following evaluations were conducted and the results were shown in Table 4.

(1) Fixing Performance

Temperature of the fixing device was set forth at an optional temperature and imaging was carried out. Using cotton cloth the image was rubbed and density difference before and after rubbing was measured as fixing ratio. The fixing ratio was calculated from an equation (reflection density after rubbing)/(density before rubbing)×100 (%). For evaluation 70–90 (%) was evaluated as B (Good), more than 90% as A (Very Good) and less than 70% as X (Problematic).

As for the heat roll fixing method, a modified copying machine Type-3035, a product of Konica Corporation, was used, and the fixing temperature was set at 160° C.

Anti-Hot-offset Property

After setting the temperature of the fixing device at an arbitrary temperature, 100 continuous copying was conducted and occurrence of hot offset was evaluated by visual observation. Evaluation was made A when no hot offset was observed and X when occurrence of hot offset was observed.

As for the heat roll fixing method, a modified copying machine Type-3035, a product of Konica Corporation, was used, and the fixing temperature was set at 220° C.

Anti-Contamination Property

Automatic double-sided copying was conducted using an electrophotographic copying machine Type-3035, a product of Konica Corporation, and occurrence of contamination in the image by conveyance roller and by rubbing of papers each other was evaluated by visual judgment. Evaluation was made to be A when contamination was observed and X when no contamination was observed.

Anti-Blocking Property 2 g each of toner was taken in the sample tube and after 500 tapping operation the toner was left under 60° C. and 20% R.H. for two hours. Then the toner was sieved with a 48-mesh sieve for ten seconds, and the proportion of the toner remained on the sieve with respect to the total amount of the toner was determined in terms of percentage. Evaluation was made in the following three grades.

20–40% (a little blocking observed): B not more than 20% (no blocking observed: A more than 40% (problematic blocking observed): X Dispersion of Additives At the time when the binder resin, carbon black, and polypropylene wax were fused and kneaded, a kneaded toner plate was taken out and the state of dispersion of this carbon black in the plate was observed using a transparent-type electron microscope. Evaluation was made as follows.

No carbon black blocking was observed: A

Blocking of carbon black was observed: X

Electrification Property

Using toner, to which treatment with silica as an additive has not been conducted, amount of electrification under low humidity condition and under high humidity condition was evaluated. One (1) g of silica-untreated toner and 19 g of fluorine resin-coated carrier were taken in a sample tube, and left for two hours under humidity conditions of 20% R.H. And 80% R.H., respectively. Then the toner was stirred and mixed for 20 minutes using a vibrator and amount of electrification was measured using a blow-off electrification measuring apparatus.

Evaluation was made to be A (No problem) when electrification difference between low humidity measurement and high humidity measurement was less than 6 μC/g and X (problematic) when it is not smaller than 6 μC.

TABLE 4

| Sample No. | Fixing Performance | Offset Property | Contamination | Blocking | Dispersion | Electrification Property |
|---|---|---|---|---|---|---|
| Toner 1 | B(78%) | A | A | B(30%) | A | A(3 μC/g) |
| Toner 2 | B(85%) | A | A | B(35%) | A | A(1 μC/g) |
| Toner 3 | B(75%) | A | A | B(31%) | A | A(3 μC/g) |
| Toner 4 | B(74%) | A | A | B(32%) | A | A(1 μC/g) |
| Toner 5 | B(72%) | A | A | B(25%) | A | A(1 μC/g) |
| Toner 6 | B(79%) | A | A | B(28%) | A | A(2 μC/g) |
| Toner 7 | B(72%) | A | A | B(25%) | A | A(3 μC/g) |
| Toner 8 | A(92%) | A | A | X(40%) | X | A(4 μC/g) |
| Toner 9 | X(62%) | A | A | A(10%) | A | A(1 μC/g) |
| Toner 10 | B(85%) | A | A | B(28%) | X | A(3 μC/g) |
| Toner 11 | B(82%) | A | A | B(32%) | X | A(2 μC/g) |
| Toner 12 | B(82%) | X | A | B(28%) | A | A(5 μC/g) |
| Toner 13 | X(65%) | A | A | B(38%) | A | A(1 μC/g) |
| Toner 14 | X(60%) | A | A | B(28%) | A | A(4 μC/g) |
| Toner 15 | B(90%) | X | A | B(29%) | A | A(5 μC/g) |
| Toner 16 | B(83%) | X | A | B(32%) | A | A(4 μC/g) |
| Toner 17 | X(65%) | A | A | A(9%) | A | A(1 μC/g) |
| Toner 18 | B(85%) | A | A | X(52%) | A | A(2 μC/g) |
| Toner 19 | X(69%) | A | A | B(25%) | A | A(0 μC/g) |
| Toner 20 | B(82%) | A | A | X(43%) | A | X(7 μC/g) |
| Toner 21 | X(60%) | A | A | B(39%) | A | A(3 μC/g) |
| Toner 22 | B(79%) | A | X | B(25%) | A | A(5 μC/g) |

From the results shown in Table 4, it is found that by the use of the electrophotographic toner and the fixing method of the toner image according to the present invention, fixing performance at low temperatures, anti-hot offset property, anti-contamination property, anti-blocking property and electrification property are all satisfactory.

By the use of the electrophotographic toner and the fixing method of the toner image according to the present invention, it is possible to satisfy all of fixing performance at low temperatures, anti-hot offset property, anti-contamination property, anti-blocking property and electrification property. In other words, by the use of the toner of the present invention, speeding up of the photocopying machine, automation, down-sizing and enhancement of image quality were easily achieved.

We claim:

1. An electrophotographic toner comprising a binder resin, a colorant, and a releasing agent, wherein the molecular weight distribution of the binder resin measured by gel permeation chromatography satisfies that (1) said binder resin has a main peak in the molecular weight range between 3,000–5,000;

(2) said binder resin has a peak or a shoulder in the molecular weight range between 80,000–240,000;

(3) said binder resin has a peak or a shoulder in the molecular weight range between 400,000–650,000;

(4) component having the molecular weight less than 20,000 is 56–70% by weight;

(5) component of having the molecular weight between 20,000–300,000 is 8–32% by weight;

(6) component having the molecular weight greater than 300,000 is 12–28% by weight;

(7) HP content and MP content satisfy the following relation;

$$45\ (\%) \leqq \text{MP Ratio} + \text{HP Ratio} \times 2 \leqq 65\ (\%);$$

wherein MP Ratio is content of the medium molecular weight component having the molecular weight between 20,000–300,000 of the resin in percent, and HP Ratio is content of the high molecular weight component having the molecular weight greater than 300,000 of the resin in percent, and that the glass transition point of said resin is between 52° C. and 62° C.

2. An electrophotographic toner of claim 1 wherein a polymer of the binder resin has an acid ingredient in the low molecular weight component having the molecular weight less than 20,000 or the medium molecular weight component having the molecular weight between 20,000–300,000.

3. An electrophotographic toner of claim 2 wherein acid value of the toner is 0.1–5 KOH mg/g.

4. An electrophotographic toner of claim 2 wherein the polymer of the binder resin comprises acrylic acid or methacrylic acid as a monomer composing the polymer.

5. An electrophotographic toner of claim 2 wherein the releasing agent is molecular weight polyolefin or its derivative, alkylene bis aliphatic fatty acid amide compound or paraffin wax.

* * * * *